US009253581B2

(12) United States Patent
Aubreville et al.

(10) Patent No.: US 9,253,581 B2
(45) Date of Patent: Feb. 2, 2016

(54) METHOD OF CONTROLLING AN EFFECT STRENGTH OF A BINAURAL DIRECTIONAL MICROPHONE, AND HEARING AID SYSTEM

(71) Applicant: SIVANTOS PTE. LTD., Singapore (SG)

(72) Inventors: Marc Aubreville, Nuremberg (DE); Eghart Fischer, Schwabach (DE); Homayoun Kamkar Parsi, Erlangen (DE)

(73) Assignee: Sivantos Pte. Ltd., Singapore (SG)

( * ) Notice: Subject to any disclaimer, the term of this patent is extended or adjusted under 35 U.S.C. 154(b) by 0 days.

(21) Appl. No.: 14/257,154

(22) Filed: Apr. 21, 2014

(65) Prior Publication Data

US 2014/0314260 A1 Oct. 23, 2014

(30) Foreign Application Priority Data

Apr. 19, 2013 (DE) ..... 10 2013 207 149

(51) Int. Cl.
*H04R 25/00* (2006.01)

(52) U.S. Cl.
CPC ..... *H04R 25/552* (2013.01); *H04R 25/405* (2013.01); *H04R 25/407* (2013.01); *H04R 2225/43* (2013.01); *H04R 2430/20* (2013.01); *H04R 2430/21* (2013.01); *H04R 2430/23* (2013.01)

(58) Field of Classification Search
CPC ..... H04R 1/20; H04R 1/32; H04R 1/326; H04R 1/40; H04R 1/406; H04R 5/033; H04R 5/04; H04R 25/40; H04R 25/405; H04R 25/407; H04R 25/43; H04R 2225/41; H04R 2225/43; H04R 2430/20; H04R 2430/21; H04R 2430/23
USPC ..... 381/23.1, 309–311, 313, 317, 320, 321, 381/92, 370; 181/129, 130, 135
See application file for complete search history.

(56) References Cited

U.S. PATENT DOCUMENTS

| | | | | |
|---|---|---|---|---|
| 5,511,128 | A * | 4/1996 | Lindemann | 381/92 |
| 5,600,326 | A * | 2/1997 | Yu et al. | 342/17 |
| 6,243,322 | B1 * | 6/2001 | Zakarauskas | 367/127 |
| 6,424,721 | B1 * | 7/2002 | Hohn | 381/313 |
| 6,449,586 | B1 * | 9/2002 | Hoshuyama | 702/190 |
| 6,549,633 | B1 * | 4/2003 | Westermann | 381/312 |
| 7,242,781 | B2 * | 7/2007 | Hou | 381/92 |

(Continued)

FOREIGN PATENT DOCUMENTS

| | | | |
|---|---|---|---|
| DE | 102008015263 | A1 | 10/2009 |
| DE | 102012204877 | B3 | 4/2013 |

*Primary Examiner* — Curtis Kuntz
*Assistant Examiner* — Joshua Kaufman
(74) *Attorney, Agent, or Firm* — Laurence A. Greenberg; Werner H. Stemer; Ralph E. Locher

(57) ABSTRACT

A hearing aid system has at least two hearing aid devices to be worn on both sides of a wearer's head. The hearing aid devices have a transducer for picking up an acoustic signal and converting same into a first audio signal in each case. A signal processing unit processes audio signals received from each hearing aid device through a signal connection. The signal processing unit evaluates a signal component from a preferred direction in relation to the head of the wearer in the first audio signals. By way of the first audio signals the signal processing unit generates a first binaural directional microphone signal and adjusts its directional characteristic as a function of the evaluation.

13 Claims, 2 Drawing Sheets

(56) References Cited

U.S. PATENT DOCUMENTS

| | | | | |
|---|---|---|---|---|
| 7,492,908 | B2 * | 2/2009 | Griesinger | 381/56 |
| 7,688,990 | B2 * | 3/2010 | Hellgren et al. | 381/312 |
| 7,831,052 | B2 * | 11/2010 | Puder | 381/23.1 |
| 7,933,423 | B2 * | 4/2011 | Baekgaard Jensen et al. | 381/312 |
| 8,565,446 | B1 * | 10/2013 | Ebenezer | 381/94.1 |
| 8,744,101 | B1 * | 6/2014 | Burns | 381/313 |
| 9,113,247 | B2 * | 8/2015 | Chatlani | H04R 25/407 |
| 2003/0147538 | A1 * | 8/2003 | Elko | 381/92 |
| 2004/0175008 | A1 * | 9/2004 | Roeck et al. | 381/312 |
| 2005/0025325 | A1 * | 2/2005 | Fischer | 381/313 |
| 2006/0115097 | A1 * | 6/2006 | Rasmussen | 381/92 |
| 2006/0227976 | A1 * | 10/2006 | Csermak et al. | 381/1 |
| 2007/0160242 | A1 * | 7/2007 | Cadalli et al. | 381/312 |
| 2007/0269064 | A1 | 11/2007 | Allegro-Baumann et al. | |
| 2008/0089523 | A1 * | 4/2008 | Roeck | 381/23.1 |
| 2008/0212810 | A1 * | 9/2008 | Pedersen | 381/312 |
| 2008/0260175 | A1 * | 10/2008 | Elko | 381/73.1 |
| 2008/0304670 | A1 * | 12/2008 | Breebaart | 381/17 |
| 2009/0003626 | A1 * | 1/2009 | Burnett | 381/92 |
| 2009/0175466 | A1 * | 7/2009 | Elko et al. | 381/94.2 |
| 2009/0238385 | A1 | 9/2009 | Fischer | |
| 2009/0304187 | A1 * | 12/2009 | Dittberner | 381/23.1 |
| 2009/0304188 | A1 * | 12/2009 | Mejia et al. | 381/23.1 |
| 2010/0172506 | A1 * | 7/2010 | Iwano | 381/23.1 |
| 2011/0116666 | A1 * | 5/2011 | Dittberner et al. | 381/313 |
| 2012/0020503 | A1 * | 1/2012 | Endo et al. | 381/312 |
| 2012/0127832 | A1 * | 5/2012 | Mejia | 367/124 |
| 2012/0128163 | A1 * | 5/2012 | Moerkebjerg et al. | 381/23.1 |
| 2012/0189147 | A1 * | 7/2012 | Terada et al. | 381/313 |
| 2013/0108058 | A1 * | 5/2013 | Launer et al. | 381/23.1 |
| 2013/0259239 | A1 | 10/2013 | Aubreville et al. | |
| 2013/0287237 | A1 * | 10/2013 | Aubreville et al. | 381/313 |
| 2014/0177857 | A1 * | 6/2014 | Kuster | 381/66 |
| 2014/0270282 | A1 * | 9/2014 | Tammi et al. | 381/300 |
| 2015/0030162 | A1 * | 1/2015 | Luo et al. | 381/23.1 |

* cited by examiner

METHOD OF CONTROLLING AN EFFECT STRENGTH OF A BINAURAL DIRECTIONAL MICROPHONE, AND HEARING AID SYSTEM

CROSS-REFERENCE TO RELATED APPLICATION

This application claims the priority, under 35 U.S.C. §119, of German patent application DE 10 2013 207 149.3, filed Apr. 19, 2013; the prior application is herewith incorporated by reference in its entirety.

BACKGROUND OF THE INVENTION

Field of the Invention

The invention relates to a method for operating a hearing aid system as well as to a hearing aid system having at least two hearing aid devices between which a signal path is provided, and having at least one signal processing unit which is provided for the purpose of processing audio signals.

In many cases hearing loss affects both ears, so the hearing-impaired person ought to be provided with hearing devices for both ears (binaurally). In this regard modern hearing devices possess signal processing algorithms which automatically vary the parameters of the hearing devices according to the hearing situation. With binaural provision of hearing assistance, the hearing situation at both ears is evaluated in this case.

Noise and interfering background sounds are omnipresent in everyday life and render speech communication more difficult, in particular when an impairment of natural hearing ability is present. Techniques are therefore desirable which, while suppressing noise and interfering background sounds, nonetheless alter the desired sounds and tones, also referred to in the following as wanted signals, as little as possible. A possible way of suppressing unwanted interfering background sounds is spatial filtering. If the interfering background sounds and the wanted sounds are incident from different directions on the wearer of a hearing aid system, it is possible to suppress unwanted noise and sounds by means of a different sensitivity of the hearing aid system in a different direction in relation to the hearing aid system and its wearer. With binaural hearing aid systems it can be beneficial in particular to combine the signals of the two hearing aid devices of the hearing aid system in order to achieve a directional effect.

However, if no source of a wanted signal is localized in a particular preferred direction, but instead the signal sources are distributed around the wearer, as in a roundtable meeting for example, then the directional effect can undesirably suppress wanted signals as well.

For this reason it was common in the past for example for the wearer to switch manually between different operating modes having either a directional characteristic or an omnidirectional sensitivity.

It is also known to control the strength of the directional characteristic on the basis of an estimated interfering background sound level, which leads to a higher computational overhead and does not directly correlate with the occurrence of a wanted signal in the preferred direction. Unfavorable settings can therefore occur in certain situations.

SUMMARY OF THE INVENTION

It is accordingly an object of the invention to provide a method and device that control the effect strength of a binaural directional microphone and which overcome the above-mentioned disadvantages of the heretofore-known devices and methods of this general type and which provide for a method for operating a hearing device system and also a hearing device system by way of which a better and more effective spatial suppression of noise and interfering background sounds is realized.

With the foregoing and other objects in view there is provided, in accordance with the invention, a method of operating a hearing aid system having at least two hearing aid devices to be respectively worn on two sides of the head of a wearer, each of the hearing aid devices having a transducer for picking up an acoustic signal and converting the acoustic signal into a first audio signal, and the hearing aid system having a signal processing unit for processing audio signals and a signal connection for transmitting a first audio signal from each hearing aid device to the signal processing unit, the method comprising:

evaluating with the signal processing unit a signal component from a preferred direction in relation to the head of the wearer in the first audio signals; and based on the first audio signals, generating with the signal processing unit a first binaural directional microphone signal and adjusting a directional characteristic of the signal as a function of the evaluating step.

In other words, the novel method according to the invention relates to operating a hearing aid system having at least two hearing aid devices for arrangement in accordance with the intended application on the two sides of a wearer's head. The hearing aid devices have a transducer for picking up an acoustic signal and converting same into a first audio signal in each case. The hearing aid system additionally has a signal processing unit for processing audio signals as well as a signal connection for transmitting a first audio signal from each hearing aid device to the signal processing unit. The signal processing unit evaluates a signal component from a preferred direction in relation to the head in the first audio signals and by means of the first audio signals generates a first binaural directional microphone signal and adjusts the directional characteristic of said signal as a function of the evaluation.

Because the hearing aid system evaluates signal components from the preferred direction, it can be reliably established whether a signal source is actually also present in the preferred direction. This advantageously avoids a directional characteristic being activated when no signal source is present in the preferred direction.

The inventive hearing aid system for performing the inventive method shares the advantages of said method. With the above and other objects in view there is thus provided, in accordance with the invention, a hearing aid system, comprising:

at least two hearing aid devices to be worn on both sides of a head, each of the hearing aid devices having a transducer for picking up an acoustic signal and converting the acoustic signal into a first audio signal;

a signal processing unit for processing audio signals and a signal connection for transmitting a first audio signal from each of the hearing aid devices to the signal processing unit, the signal processing unit being configured to:

perform an evaluation of a signal component from a preferred direction in relation to the head in the first audio signals;

generate a first binaural directional microphone signal from the first audio signals; and adjust the directional characteristic of the signal as a function of the evaluation.

In other exemplary embodiments, the preferred direction is mapped into a symmetry plane of the two hearing aid devices on the basis of a preprocessing of the first audio signals. As a result of this transformation the preferred direction for the following steps is aligned with the line of sight of the wearer's head.

Advantageously, the following steps can therefore be configured for the preferred direction in the line of sight and do not have to be adjusted to a preferred direction that is changing in each case. In particular it is also possible in this way to utilize symmetry properties of said preferred direction.

In a possible embodiment variant, the signal processing unit determines a minimum for the level of the first audio signals or a minimum for the level of the first preprocessed audio signals. From the minimum and a second reference signal having a reduced sensitivity in the preferred direction, the signal processing unit then forms a quotient for the purpose of evaluating the signal component.

Defining the minimum for the levels and for the quotient permits a measure to be determined in a simple manner for sounds from a direction not equal to the preferred direction and thereby subsequently to adjust the directional effect to the hearing situation.

In accordance with a further feature of the invention, in order to evaluate the signal component from a preferred direction the signal processing unit determines a quotient from a first reference signal with directional characteristic in the preferred direction and a second reference signal having a reduced sensitivity in the preferred direction.

Advantageously, forming a quotient from a first reference signal with directional characteristic in the preferred direction and a second reference signal having a reduced sensitivity in the preferred direction also allows the case to be taken into account whereby a high noise or sound level is incident from all directions, including from the preferred direction. Since both the denominator and the numerator increase in equal measure, the situation can be recognized on the basis of the quotient and an increase in the directional characteristic which would not improve intelligibility can be avoided.

In an embodiment variant of the method according to the invention, the first reference signal is a weighted sum of the first audio signals of both hearing aid devices.

Forming a weighted sum of the first audio signals of the two hearing aid devices enables a signal to be provided at low computational overhead, which signal has for example a directional characteristic having a maximum of sensitivity in the line of sight of the wearer of the hearing aid devices.

In a possible embodiment variant of the method according to the invention, the first audio signals are weighted adaptively in such a way that an energy of the weighted sum is minimized.

The noise and interfering background sounds component is already reduced as a result of the adaptive adjustment of the coefficients in that a combination having the lowest energy of noise and interfering background sounds is selected.

In accordance with an added feature of the invention, the second reference signal is a weighted difference of the first audio signals of both hearing aid devices.

Forming a weighted difference of the first audio signals of the two hearing aid devices enables a signal to be provided at low computational overhead, which signal has for example a directional characteristic having a minimum of sensitivity in the line of sight of the wearer of the hearing aid devices.

In accordance with an additional feature of the invention, the second reference signal is a signal of a binaural figure of eight which has a minimum along the preferred direction. A binaural figure of eight is a signal that is generated from the difference of the signals of two omnidirectional or monaural directional microphones that are spaced at a distance from each other.

A binaural figure-of-eight signal is particularly easy to generate and advantageously exhibits a pronounced minimum of sensitivity in a plane which is aligned centrally between the hearing aid devices and parallel to the line of sight. This is of advantage in particular if the preferred direction lies in said plane.

In accordance with a preferred feature of the invention, the signal processing unit increases the directional characteristic of the binaural directional microphone in step with an increasing value of the quotient.

An increasing value of the quotient indicates that in the preferred direction there is a signal present which is singled out from the ambient noise and sounds. Increasing the directional characteristic then advantageously emphasizes said signal relative to the ambient noise and sounds, which are simultaneously attenuated as a result of the stronger directional characteristic.

In another embodiment variant of the method according to the invention, in order to evaluate the signal component the signal processing unit determines a cross-correlation of the first audio signals of the two hearing aid devices.

By means of the cross-correlation it is possible to establish the degree to which the two signals are similar to each other and therefore originate from a common source. If the cross-correlation is particularly high, the two signals are almost identical and can therefore be assigned to a source at the same distance from both microphones, which in a preferred direction in the line of sight of the wearer advantageously lie in said preferred direction.

In a possible embodiment variant, the signal processing unit increases the directional characteristic of the binaural directional microphone as the cross-correlation increases.

An increasing value of the cross-correlation indicates that a signal source is present in the preferred direction. Increasing the directional characteristic then advantageously emphasizes said signal source relative to the ambient noise and sounds, which are simultaneously attenuated as a result of the stronger directional characteristic.

In an embodiment variant of the method according to the invention it is also conceivable for the evaluation of the signal components from the preferred direction in the first audio signals to be performed individually for at least two different frequency ranges and for the directional characteristic of the first binaural directional microphone signal to be set individually for each frequency range as a function of the evaluation.

A different evaluation and directional characteristic for different frequency ranges advantageously enable different propagation conditions for different frequencies to be taken into account or also different signal sources in different frequency ranges to be treated differently.

Other features which are considered as characteristic for the invention are set forth in the appended claims.

Although the invention is illustrated and described herein as embodied in a controlling the effect strength of a binaural directional microphone, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawing figures.

DETAILED DESCRIPTION OF THE INVENTION

Figure 1:
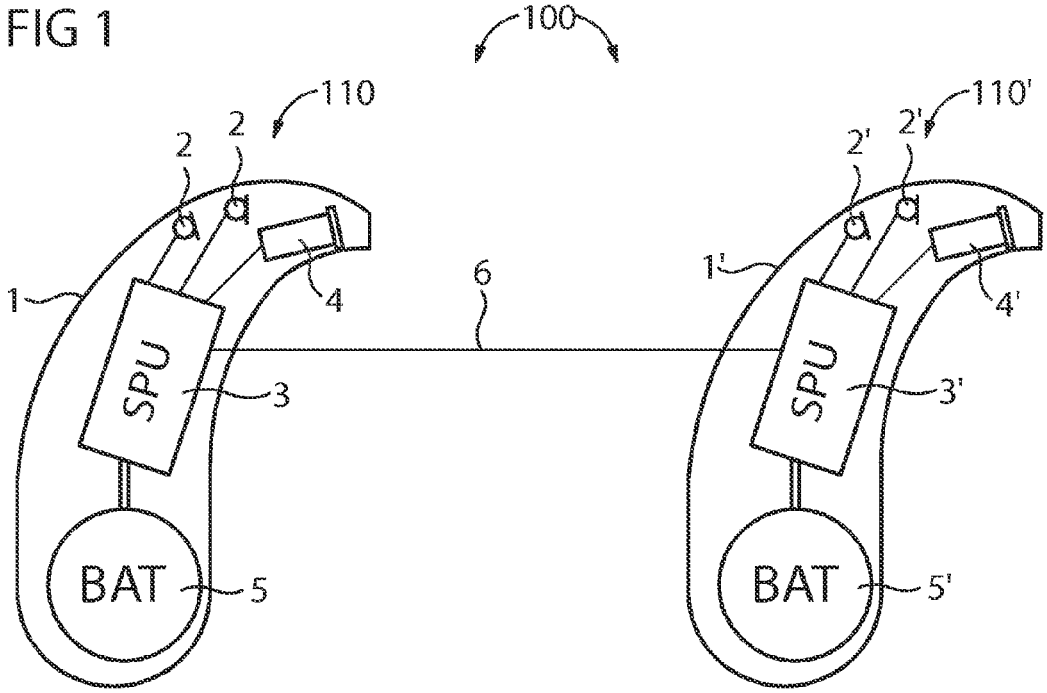
FIG. 1 is a schematic representation of a hearing aid system according to the invention.

Referring now to the figures of the drawing in detail and first, particularly, to FIG. 1 thereof, there is shown the basic layout of a hearing aid system 100 according to the invention. The hearing aid system 100 has two hearing aid devices 110, 110', each in the form of a BTE (behind-the-ear) device. One or more microphones 2, 2' for picking up the sound or acoustic signals from the environment are installed in a hearing device housing 1, 1' for wearing behind the ear. The microphones 2, 2' are transducers 2, 2' for converting the sound into first audio signals. The first acoustic signals are for example analog or digital electrical signals. A signal processing unit (SPU) 3, 3' which is likewise integrated into the hearing device housing 1, 1' processes the first audio signals. The output signal of the signal processing unit 3, 3' is transmitted to a loudspeaker or receiver 4, 4' which outputs an acoustic signal. The sound is transmitted, where appropriate by way of a sound tube fixed in the auditory canal by means of an earmold, to the device wearer's eardrum. Power is supplied to the hearing device and in particular to the signal processing unit 3, 3' by means of a battery 5, 5' which is likewise integrated into the hearing device housing 1, 1'.

In addition, the hearing aid system 100 has a signal connection 6 which is designed to transmit a first acoustic signal from the signal processing unit 3 to the signal processing unit 3'. In this case it is provided in the preferred embodiment variant that signal processing unit 3' also transmits a first acoustic signal in the opposite direction to the signal processing unit 3. It is furthermore conceivable for the signals of a plurality of or of all of the microphones 2, 2' to be transmitted to the other hearing aid device 110, 110' in each case.

Wired, optical or even wireless connections such as, for instance, Bluetooth are conceivable as signal connection 6.

It will be readily understood that, in addition to the illustrated BTE (behind-the-ear) hearing aid devices, the method according to the invention is also suitable for application in other hearing aid devices, such as in an ITE (in-the-ear) hearing aid device, for example.

Figure 2:
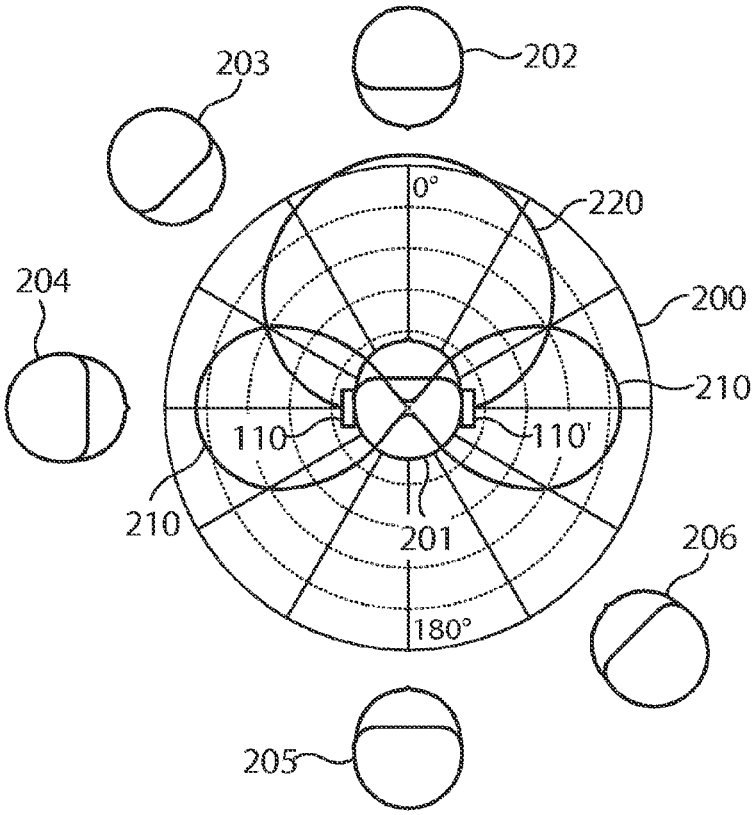
FIG. 2 shows an arrangement of hearing aid system and signal sources.

FIG. 2 shows a schematic arrangement of an inventive hearing aid system, its wearer and the signal sources in a plan view from above.

The wearer 201 of the hearing aid devices 110, 110' is arranged in the center of a polar coordinate system 200. The wearer 201 wears the hearing aid devices 110, 110' in accordance with the intended application, in the case of BTE hearing aid devices, for example, behind the respective ear, or in the respective auditory canal in the case of ITE hearing aid devices. The line of sight of the wearer 201 is to the front, corresponding to the 0-degrees direction in the polar diagram. In the following example the preferred direction is assumed to be parallel to the line of sight. However, it is also conceivable for the preferred direction to be arranged at an angle to the line of sight. It would also be conceivable for the preferred direction to be determined in advance in each case by means of an adaptive method and for the first audio signals to be preprocessed in such a way that the preferred direction is mapped onto or transformed into the 0 degrees direction. Preprocessing could for example take the form of an adjustment of the amplitude and phase of the first audio signals. Subsequent processing steps can then process the preprocessed first audio signals as though their origin lay in the 0 degrees direction. In this case it is possible for example to use symmetry properties or head shadowings of audio signals having said origin.

A speaker 202, assumed in the following as the source of a wanted signal in the preferred direction, is situated in the preferred direction. Other persons 203, 204, 205 and 206 are arranged at other angles to the wearer 201. Also depicted in the drawing is a binaural figure of eight 210 which indicates a directional characteristic of a difference signal of the first audio signals of the two transducers of the two hearing aid devices of the binaural hearing aid system. Additionally indicated is a directional characteristic 220 which is produced for example as a result of a weighted summation of the first audio signals of the two transducers of the two hearing aid devices of the binaural hearing aid system. The directional characteristic 220 has a maximum of sensitivity in the 0 degrees preferred direction.

Figure 3:
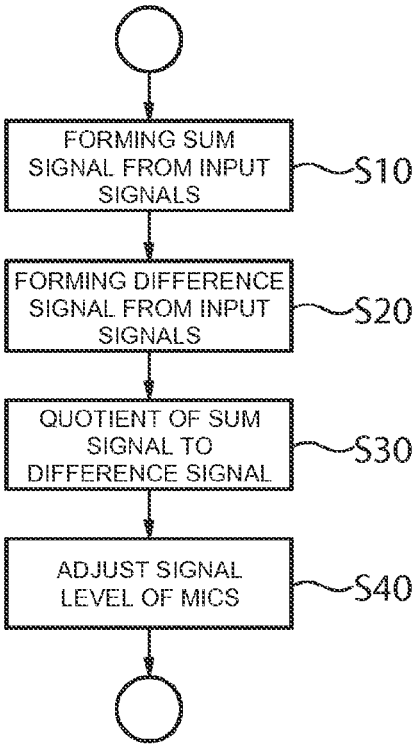
FIG. 3 is a flowchart of a method according to the invention.

FIG. 3 shows a schematic flowchart of a method according to the invention in the signal processing unit 3, 3'.

In step S10, the signal processing unit 3 forms a sum signal from the first audio signals of the transducers 2, 2'. The sum signal exhibits a maximum of sensitivity in the preferred direction in which speaker 202 is also arranged. The directional characteristic can for example equal the directional characteristic 220 in FIG. 2. In the simplest form the first audio signals are added directly. It is, however, also conceivable for the first audio signals to be corrected initially in terms of their amplitude and phase in order for example to choose a different preferred direction or to compensate for tolerances between the transducers 2, 2'. It is possible in this case for the correction to be realized in the form of an adaptive filter. This could be a Wiener filter, for example. The coefficients can be chosen such that the energy content of the sum signal is minimal, thereby already attenuating acoustic signals not originating from the preferred direction. This would also allow head shadow effects to be used in a targeted manner in order to achieve a signal having the greatest possible component from the preferred direction.

It is furthermore also conceivable to combine not just two, but the signals of a plurality of microphones. Thus, for example, each hearing aid device may have a monaural directional microphone which is combined from two omnidirectional microphones in each case. The signal processing unit 3, 3' can then combine said first audio signals into audio signals having a higher-order directional effect.

In step S20, the signal processing unit 3, 3' forms a difference signal from the first audio signals of the transducers 2, 2'. A possible directional characteristic 210 of the difference signal is represented in the form of a binaural figure of eight in FIG. 2. The difference signal exhibits a minimum of sensitivity in the preferred direction of the speaker 202. The directional characteristic 210, on the other hand, has an increased sensitivity in directions not equal to the preferred direction, such that acoustic signals of the speakers 203, 204 205 or 206 lead to stronger first acoustic signals relative to acoustic signals of the speaker 202. As already indicated with reference to S10, the difference signal can also be formed from a plurality of first audio signals in order to realize higher-order directional characteristics.

In step S30, the signal processing unit 3, 3' forms a quotient from the sum signal and the difference signal. In the following discussion it is assumed for the sake of simplicity that the transducers 2, 2' supply first audio signals with a level value of 1 for the speaker 202 and the factors in the summation and the difference calculation are equal to 1 in each case, i.e. the signals are normalized. For other assumptions it is necessary to scale the discussed values accordingly, although the inventive concept is not altered thereby and these embodiment variants fall under the scope of protection of the invention.

For a speaker 202 as signal source, the quotient assumes a value significantly greater than 1, since on account of the minimum of the directional characteristic 210 in the preferred direction the difference signal is small and in the theoretical extreme case even goes toward zero. At the same time the sum signal is at a maximum, which would be a value of 2 for normalized sensitivity. The quotient increases correspondingly to large positive values.

For a speaker 203 as signal source, the signal value of the difference signal goes toward a value equaling that of the sum signal, since the two directional characteristics 210, 220 intersect in the direction of the speaker 203. The quotient itself goes toward the value 1.

For a speaker 204 as signal source, the signal value of the difference signal goes toward a maximum, while the sum signal goes toward a value less than 1 and greater than 0 in the direction 0. The quotient itself likewise goes toward a value less than 1 and greater than 0 in the direction 0. A similar situation applies to speaker 206. Typical values for the quotient then lie between 0.5 and 0.25.

In a step S40, the signal processing unit 3, 3' inventively increases the directional characteristic of the binaural directional microphone signal if the quotient increases or exceeds a predetermined value. Referred to a normalized audio signal, said value can be 0, 5 or 1, for example. For signal sources in the preferred direction in which for example the speaker 202 is situated, the binaural directional microphone signal then has a greater signal level, whereas the signal has a lower signal level for example for signal sources such as speakers 203, 204, 205 or 206 in other directions at an angle to the preferred direction. In one embodiment variant, the directional characteristic can be increased in that the binaural directional microphone signal is obtained by means of a weighted overlaying of the sum signal and an omnidirectional microphone signal, wherein the sum signal is weighted more heavily compared with the omnidirectional signal in order to increase the directional characteristic. Other combinations of higher-order binaural directional microphones with an omnidirectional microphone signal are also conceivable, however.

Conversely, the signal processing unit 3, 3' according to the invention lowers the directional characteristic of the binaural directional microphone signal in step S40 if the quotient decreases. This is the case, as already described, for speaker 204, for example. If the directional characteristic is lowered, the sensitivity of the binaural directional microphone increases for directions at an angle to the preferred direction, while decreasing in the preferred direction. For the small values of the quotient discussed for example in relation to speaker 204 with reference to step S30, the binaural directional microphone no longer has any directional characteristic, in other words its directivity is omnidirectional. Accordingly, for signal sources in the preferred direction in which for example the speaker 202 is situated, the signal level of the binaural directional microphone is equal to that for signal sources such as speakers 203, 204, 205 or 206 in other directions at an angle to the preferred direction.

In an alternative embodiment variant of the method according to the invention, the minimum from the first audio signals or, as the case may be, the first preprocessed audio signals is determined in step S10 instead of the sum. In step S30, the quotient from the determined minimum and the difference of the first audio signals or the first preprocessed audio signals is then formed accordingly. In other respects the alternative method corresponds to the method already described.

In a further alternative embodiment variant of the method according to the invention, the signal processing unit 3, 3' determines a value for the cross-correlation of the first audio signals in step S10' instead of the quotient. If the origin of an audio signal is in the symmetry plane between the two hearing aid devices 110, 110', then in the ideal case the first audio signals are identical and have a high value for the cross-correlation. The cross-correlation decreases correspondingly for values outside. The same applies if the first audio signals originate from a multiplicity of independent, spatially distributed sources.

In a step S40' of the further alternative embodiment variant of the method, analogously to S40, the signal processing unit 3, 3' increases the directional characteristic of the binaural directional microphone signal if the value of the cross-correlation increases or assumes a value greater than zero, and reduces the directional characteristic of the binaural directional microphone signal if the value for the cross-correlation decreases.

The quotient formation steps S20 and S30 are omitted analogously in the alternative embodiment variant of the method.

It is also conceivable in the methods according to the invention that the preferred direction does not lie in the symmetry plane between the hearing aid devices. Thus, for example, it is possible by means of different transducers 2, 2' or by means of different preprocessing of the signals of first audio signals prior to a summation or difference formation to align the preferred direction in a different direction outside of the symmetry plane of the two hearing aid devices 110, 110'. The same applies if, in accordance with the invention, the minimum from the first preprocessed audio signal and the second preprocessed audio signal is incorporated into the quotient as numerator instead of the sum of the first audio signals. The preprocessing of the first audio signals can be carried out continuously or else adaptively with the aid of a method which identifies a spatial direction of a sound source and determines suitable amplitude and phase corrections in order to map the spatial direction into the symmetry plane between the hearing aid devices into the line of sight of the wearer. Similarly, when a method according to the invention is performed, the speaker 202 in FIG. 2 can also be arranged in a different direction from the indicated 0-degrees preferred direction in relation to the wearer 201.

Figure 4:
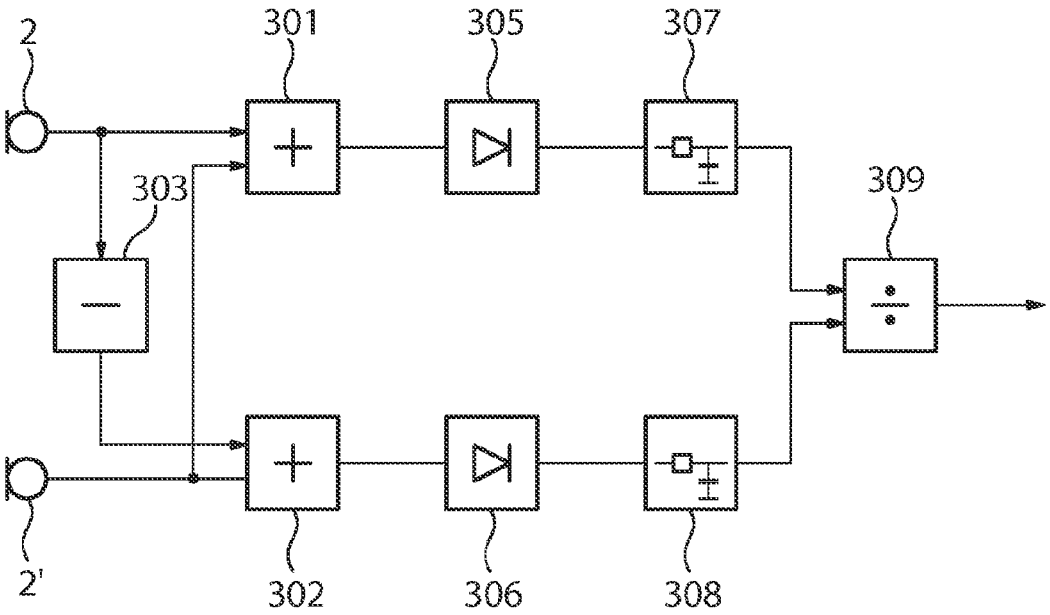
FIG. 4 is a schematic representation of quotient formation function blocks in an embodiment variant of the binaural hearing aid system.

FIG. 4 schematically shows the function blocks for producing a quotient according to the inventive method.

The transducers 2, 2' supply a signal corresponding to the sound arriving at the left and right hearing aid device 110, 110'. The first acoustic signals of the transducers are added in adder 301 or, as the case may be, subtracted in adder 302 after the inverter 303 has inverted the first acoustic signal of the transducer 2. In order to determine a level, the summation and difference signals are initially converted into absolute values or, as the case may be, rectified in rectifiers 305, 306 and averaged in the low pass filters 307, 308 before the quotient is formed in the divider 309.

According to the invention, the functions represented in FIG. 4 can be mapped by means of analog devices, digital discrete or integrated units such as ASICs or FPGAs, for example, or also implemented as software in a digital signal processor or a general-purpose processor.

Although the invention has been illustrated and described in greater detail on the basis of the preferred exemplary embodiment, it is not limited by the disclosed examples and other variations can be derived herefrom by the person skilled in the art without leaving the scope of protection of the invention.

The invention claimed is:

1. A method of operating a hearing aid system having at least two hearing aid devices to be respectively worn on two sides of the head of a wearer, each of the hearing aid devices having a transducer for picking up an acoustic signal and converting the acoustic signal into a first audio signal, and the hearing aid system having a signal processing unit for processing audio signals and a signal connection for transmitting a first audio signal from each hearing aid device to the signal processing unit, the method comprising:

evaluating with the signal processing unit a signal component from a preferred direction in relation to the head of the wearer in the first audio signals by forming with the signal processing unit a quotient from a minimum for a level of the first audio signals or from a minimum for a level of preprocessed first audio signals and a second reference signal having a reduced sensitivity in the preferred direction; and based on the first audio signals, generating with the signal processing unit a first binaural directional microphone signal and adjusting a directional characteristic of the signal as a function of the evaluating step.

2. The method according to claim 1, which comprises mapping the preferred direction into a symmetry plane of the two hearing aid devices based on a preprocessing of the first audio signals.

3. The method according to claim 1, which comprises, in order to evaluate the signal component from the preferred direction, forming with the signal processing unit a quotient from a first reference signal with directional characteristic in the preferred direction and a second reference signal having a reduced sensitivity in the preferred direction.

4. The method according to claim 3, wherein the first reference signal is a weighted sum of the first audio signals of the two hearing aid devices.

5. The method according to claim 4, which comprises adaptively weighting the first audio signals in order to minimize an energy of a weighted sum.

6. The method according to claim 3, which comprises increasing with the signal processing unit the directional characteristic of the binaural directional microphone in step with an increasing value of the quotient.

7. The method according to claim 1, wherein the second reference signal is a weighted difference of the first audio signals of the two hearing aid devices.

8. The method according to claim 7, wherein the second reference signal is a signal of a binaural figure of eight having a minimum of sensitivity along the preferred direction.

9. The method according to claim 1, which comprises increasing with the signal processing unit the directional characteristic of the binaural directional microphone in step with an increasing value of the quotient.

10. The method according to claim 1, which comprises, in order to evaluate the signal component, determining with the signal processing unit a cross-correlation of the first audio signals or of preprocessed first audio signals of the two hearing aid devices.

11. The method according to claim 10, which comprises increasing with the signal processing unit the directional characteristic of the binaural directional microphone as the cross-correlation increases.

12. The method according to claim 1, which comprises evaluating the signal components from the preferred direction in the first audio signals individually for at least two different frequency ranges, and setting the directional characteristic of the first binaural directional microphone signal individually for each frequency range as a function of the evaluation.

13. A hearing aid system, comprising:

at least two hearing aid devices to be worn on both sides of a head, each of said hearing aid devices have a transducer for picking up an acoustic signal and converting the acoustic signal into a first audio signal;

a signal processing unit for processing audio signals and a signal connection for transmitting a first audio signal from each said hearing aid device to said signal processing unit, said signal processing unit being configured to:

perform an evaluation of a signal component from a preferred direction in relation to the head in the first audio signals by forming a quotient from a minimum for a level of the first audio signals or from a minimum for a level of preprocessed first audio signals and a second reference signal having a reduced sensitivity in the preferred direction;

generate a first binaural directional microphone signal from the first audio signals; and adjust the directional characteristic of the signal as a function of the evaluation.

* * * * *